US011173985B2

(12) United States Patent
Berton

(10) Patent No.: US 11,173,985 B2
(45) Date of Patent: Nov. 16, 2021

(54) BRACKET FOR MOUNTING A THRUSTER TO A BOAT

(71) Applicant: Gerald Berton, Coral Gables, FL (US)

(72) Inventor: Gerald Berton, Coral Gables, FL (US)

( * ) Notice: Subject to any disclaimer, the term of this patent is extended or adjusted under 35 U.S.C. 154(b) by 96 days.

(21) Appl. No.: 16/844,085

(22) Filed: Apr. 9, 2020

(65) Prior Publication Data

US 2021/0316819 A1 Oct. 14, 2021

(51) Int. Cl.
*B63B 3/70* (2006.01)
*B63H 25/46* (2006.01)

(52) U.S. Cl.
CPC ..... *B63B 3/70* (2013.01); *B63H 2025/465* (2013.01)

(58) Field of Classification Search
CPC .. B63B 3/00; B63B 3/70; B63H 25/00; B63H 25/52; B63H 2025/465
USPC ..... 114/343, 364; 440/79, 82
See application file for complete search history.

(56) References Cited

U.S. PATENT DOCUMENTS 5,980,073 A * 11/1999 Whipple ..... B60Q 1/305 362/269
2014/0102350 A1* 4/2014 Marcrum ..... B63B 21/58 114/343

* cited by examiner

*Primary Examiner* — Daniel V Venne
(74) *Attorney, Agent, or Firm* — William H. Eilberg

(57) ABSTRACT

A bracket for mounting a thruster to a boat includes horizontal and vertical members disposed at right angles to each other. The horizontal member includes an enclosure which contains a lamp. A thruster is mounted to the horizontal member, and the vertical member is affixed to the transom of a boat. The thruster is therefore held in spaced-apart relation to the boat, optimizing the flow of water through the thruster, and minimizing the amount of space required, on the transom, for installation of components. The horizontal member, and one of the connectors holding the vertical member to the boat, are hollow, allowing wires to extend into the horizontal member, to provide power to the thruster and the lamp.

18 Claims, 5 Drawing Sheets

BRACKET FOR MOUNTING A THRUSTER TO A BOAT

BACKGROUND OF THE INVENTION

The present invention provides a bracket which is useful in mounting a thruster to a boat. The invention is especially intended for use with wakeboard boats, or wakesurfing boats, but is not necessarily limited to that field.

Wakeboarding or wakesurfing is a sport in which a participant stands on a board, and is towed by a boat, while maneuvering the board across the wake created by the boat, and while possibly performing various acrobatic stunts. The boat which tows the wakeboarder is called a wakeboard boat, and is designed to create a large and specially shaped wake.

It has been known to provide thrusters for boats. A thruster is essentially a small marine engine, typically electrically powered, having a propeller which engages the water, and which generates forces which can be used to turn or steer the boat. The thruster is normally auxiliary to the main engine of the boat.

Wakeboard boats are generally single-engine inboard boats, and they are very difficult to maneuver, because they typically do not have thrusters, and they have only one rudder. It has been recognized that a thruster would be desirable for use with a wakeboard boat.

Mounting a thruster to a wakeboard boat turns out to be more difficult than would first appear. Although a thruster is usually small, including essentially a small electric motor and a propeller, wakeboard boats typically have many components which limit the thruster water flow and space available for mounting a thruster. Such components may include trim tabs, wake adjusting apparatus, exhausts, and other items on the transom (i.e. the vertical surface at the stern of the boat).

Another problem with wakeboard boats is the need for light during night operations. Wakeboard boats are generally not provided with lights on the stern of the boat, and the above-described space limitations apply equally with respect to installation of a light.

The present invention solves the above-described problems, by providing a special bracket which enables a thruster to be mounted to a wakeboard boat in an advantageous operating position, and wherein the bracket also supports an underwater lamp which can work together with the thruster.

SUMMARY OF THE INVENTION

The present invention comprises a bracket for mounting a thruster to a boat, especially a wakeboard boat.

The bracket includes a horizontal member and a vertical member, positioned generally at right angles to each other. The horizontal member includes an enclosure, positioned at or near the free end of the horizontal member. The enclosure contains a lamp, the light from which is visible through a lens disposed on the face of the enclosure at or near the free end. The horizontal member includes one or more connectors for attachment of a thruster, and the vertical member includes connectors for attaching the bracket to the boat.

The horizontal member, and one of the connectors attaching the bracket to the boat, are hollow, so that wires can extend from points inside the boat to the thruster and the lamp, without exposing the wires to the water. Thus, the thruster and the lamp can be conveniently connected to a source of electrical power in the boat.

The horizontal member has a length which is preferably greater than or equal to the length of the vertical member. As a result, when the bracket has been mounted, the horizontal member extends a considerable distance away from the boat, and the thruster is thus held in a spaced apart relationship to the boat. This arrangement optimizes the flow of water through the thruster, making the thruster more efficient in maneuvering the boat, by diverting the water flow past the various components mounted to the stern of the boat. The bracket of the present invention effectively minimizes the space required, on the transom of the boat, for mounting of the thruster.

The invention also includes the combination of the bracket and a thruster, and the combination of the bracket, a thruster, and a boat.

The present invention therefore has the primary object of providing a bracket for mounting a thruster to a boat.

The invention has the further object of mounting a thruster to a boat, while using a minimal amount of space on the transom of the boat.

The invention has the further object of providing a bracket for mounting a thruster to a boat, wherein the bracket also includes illumination means for lighting the environment of the boat at night.

The invention has the further object of simplifying the mounting of a thruster to a boat, while placing the thruster in an optimal position relative to the boat.

The invention has the further object of providing a bracket for mounting a thruster in spaced-apart relation to a boat, while providing electrical connections for powering the thruster.

The reader skilled in the art will recognize other objects and advantages of the invention, from a reading of the following brief description of the drawings, the detailed description of the invention, and the appended claims.

DETAILED DESCRIPTION OF THE INVENTION

The present invention includes a bracket for mounting a thruster to a boat, especially a wakeboard boat.

Figure 1:
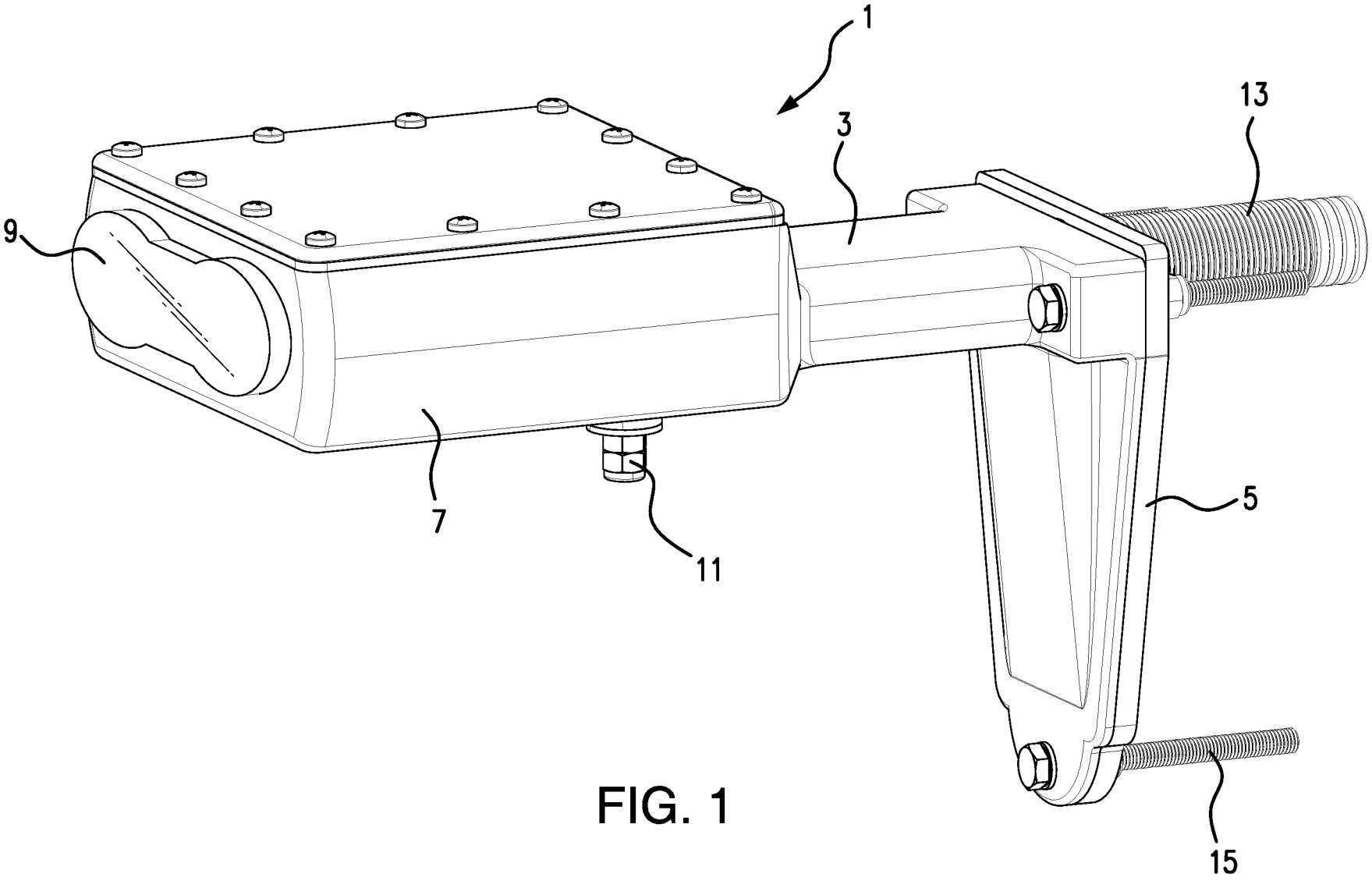
FIG. 1 provides a perspective view of the bracket of the present invention.

The bracket of the present invention is shown, in isolation, in FIG. 1. The bracket 1 includes two pieces (3, 5) generally forming a right angle. The pieces 3 and 5 are designated the horizontal member and the vertical member, respectively, because, for normal attitudes of the boat, the members will assume these orientations. The horizontal member 3 has a length which is at least as great, and preferably greater, than the length of the vertical member 5.

This feature causes the thruster to be held in spaced apart relation to the boat, as will be apparent later.

The horizontal member includes a free end, which is opposite the end that is connected to the vertical member. The free end of the horizontal member is the end at the left-hand side of FIG. 1.

The horizontal member 3 includes an enclosure 7, which is integral with, or firmly attached to, the horizontal member 3. For purposes of this description, the enclosure is considered part of the horizontal member. Thus, in FIG. 1, the horizontal member, including the enclosure 7, is clearly longer than the vertical member 5.

The enclosure 7 comprises only a portion of the horizontal member, and is disposed towards the free end of such member, so that, when the bracket is attached to the boat, the free end will be spaced away from the boat. The enclosure 7 contains a lamp, not shown in FIG. 1, but visible in FIG. 5 and indicated by reference numeral 31. When illuminated, the lamp shines its light through lens 9.

The lamp is preferably a high-power LED. However, the invention is not limited to a particular form of lamp, and other types of illuminating means could be used instead.

The horizontal member 3 is formed of a hollow tube which permits wires to be passed through the horizontal member to supply electrical power for the thruster and the lamp.

The horizontal member 3 includes one or more screws or fittings 11 for attachment of a thruster, as will be described in more detail later.

Extending from the vertical member 5 are screws 13 and 15 for attachment of the bracket to a boat. In the preferred embodiment, there is one screw 13 and three screws 15, all of the screws being visible in FIG. 2. Screw 13 has a diameter larger than the diameter of screws 15. Screw 13 is made hollow, so that wires 24, which extend through the hollow horizontal member, can be connected to a power source, and to other components, in the boat, to power the lamp and the thruster. Screws 15 are solid, not hollow, and are used simply for connection purposes. Other means of running the wires can be used instead of the arrangement described above.

The vertical member 5 can thus be attached to the transom of the boat by forming holes in the transom, inserting the screws 13 and 15 through the holes, and screwing nuts onto the screws, and tightening the nuts until the vertical member is firmly held against the transom.

Figure 2:
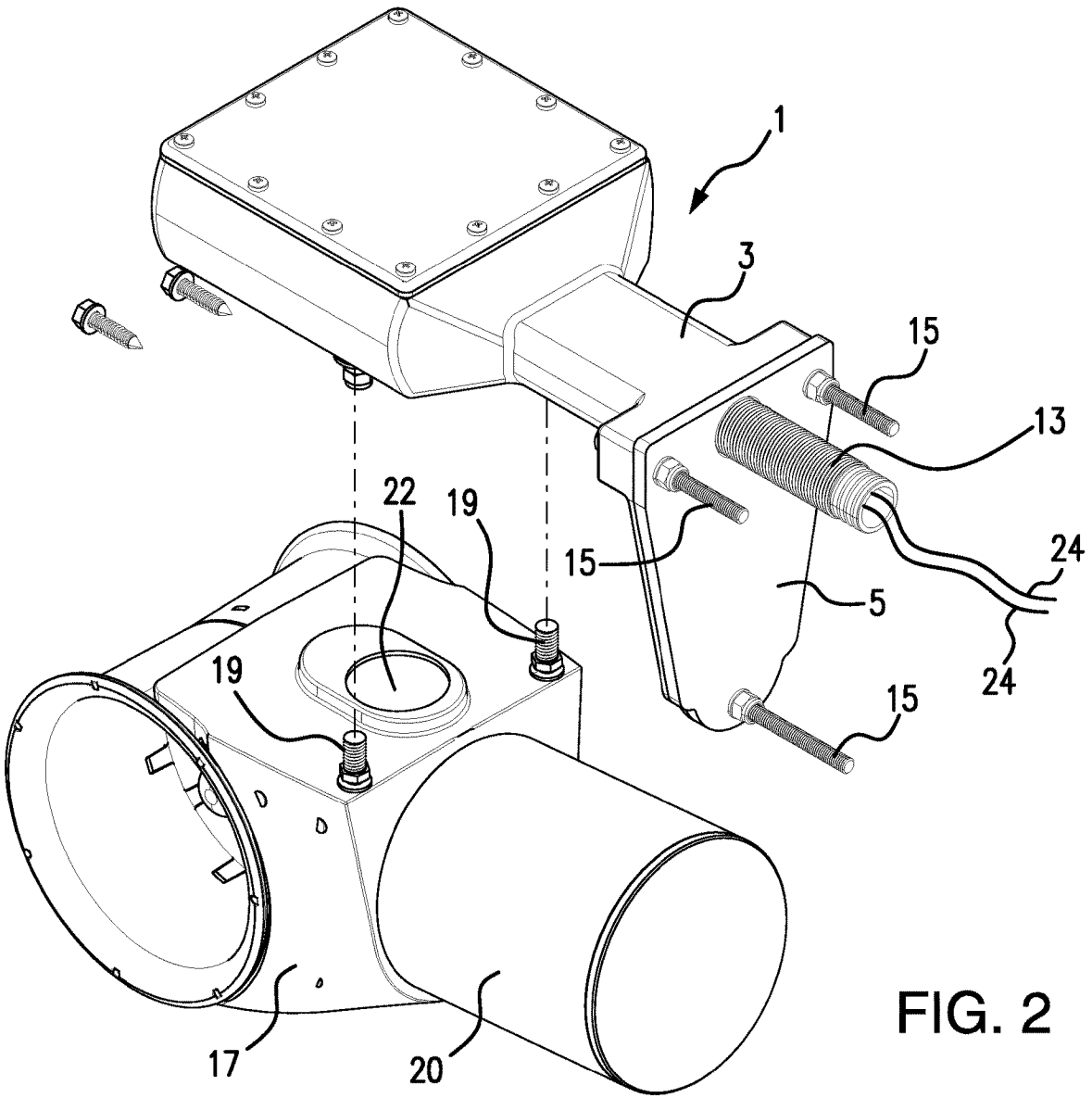
FIG. 2 provides an exploded perspective view showing the bracket of the present invention, and the thruster which is to be attached to the bracket.

FIG. 2 provides an exploded perspective view, showing the attachment of a thruster to the bracket 1 of the present invention. The thruster itself is not part of the present invention, but instead is a component which can be obtained commercially. For example, thrusters of the type shown in the present application may be obtained from Yacht Controller LLC, of Coral Gables, Fla.

As shown in FIG. 2, thruster 17 includes cylindrical housing 20 which encloses a motor (not shown) which drives the propeller of the thruster. The thruster body includes screws 19 which enable the thruster body to be mounted to horizontal member 3 of bracket 1. Thus, when the boat is in its normal attitude, the thruster is effectively suspended from, and firmly attached to, the horizontal member 3 of the bracket, while being held in a position which is spaced apart from the boat. Opening 22 allows wires from the horizontal member 3 of the bracket 1 to be connected to the thruster motor, to power the motor.

Figure 3:
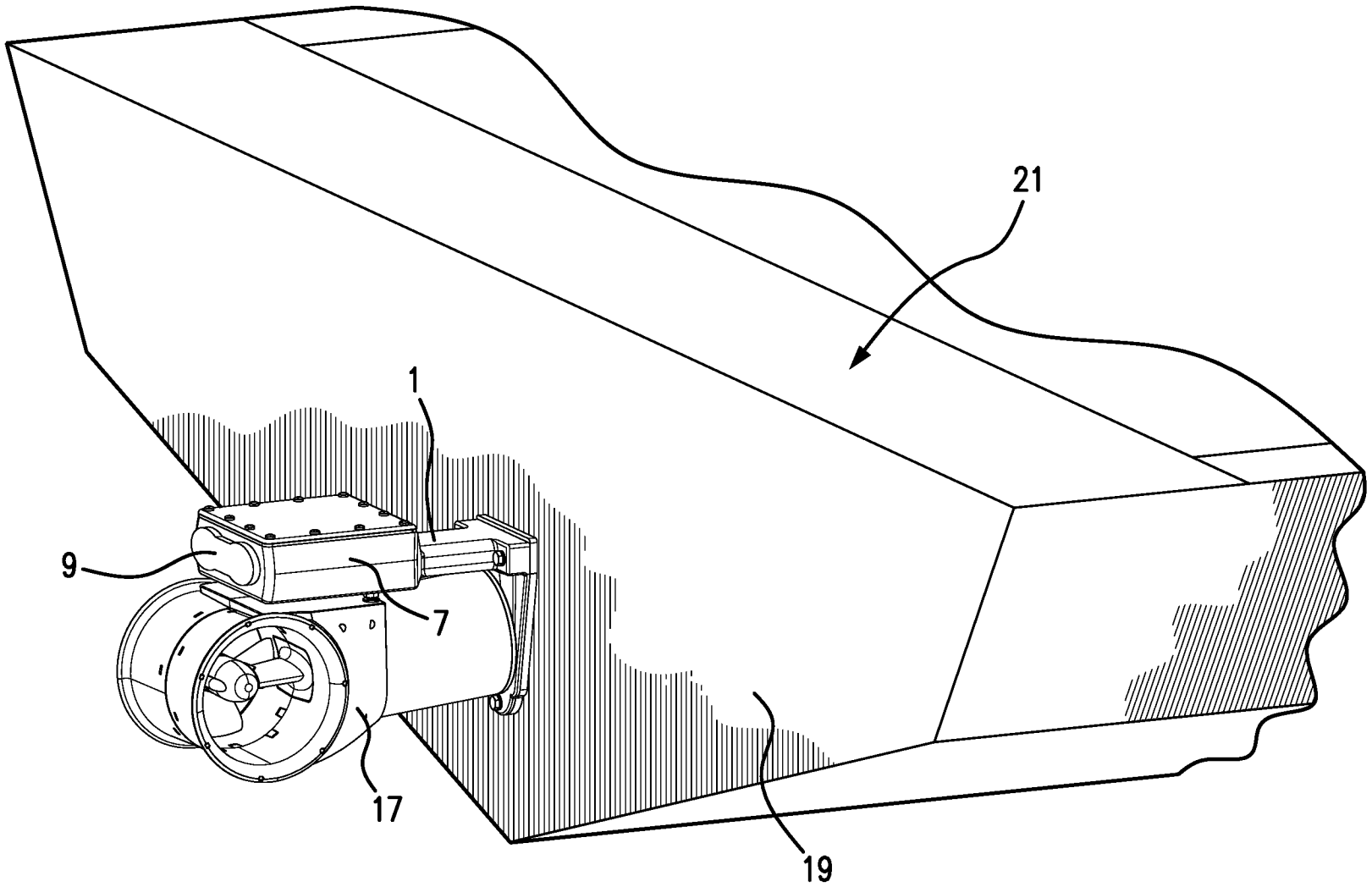
FIG. 3 provides a perspective view of the bracket of the present invention, the bracket holding a thruster, the bracket being mounted to a boat, the boat being shown in fragmentary form.

FIG. 3 shows the combination of the thruster bracket 1 of the present invention, with the thruster 17 attached to the bracket, and with the bracket attached to the transom 19 of the boat. The transom is the flat surface defining the stern of the boat.

FIG. 3 shows bracket 1, with thruster 17 attached to the underside of the horizontal member of the bracket, and with the vertical member of the bracket being attached to transom 19 of boat 21. The boat 21 is shown in fragmentary form, as the boat is not itself part of the invention, except as a member of a combination of elements. Thus, a description of the remaining portions of the boat is not considered necessary in a description of the present invention. FIG. 3 also shows the enclosure 7 of bracket 1, and the lens 9 for the lamp inside the enclosure.

For simplicity of illustration, the other components that may be present on the transom are not shown in FIG. 3. Indeed, FIG. 3 is not necessarily drawn to scale. In one embodiment, the thruster could be 5 inches wide, and the boat could be 96 inches wide, so the ratio of boat width to thruster width could be almost 20, greater than what is shown in FIG. 3. But the figure does show the general principle that the bracket of the present invention takes up relatively little space on the transom. The invention should not be considered limited to any particular set of dimensions.

The boat shown in fragmentary form in FIG. 3 is a generic boat, and not a wakeboard boat. In practice, in a wakeboard boat, the distance from the bottom of the boat to the top of the stern, i.e. the distance from the bottom to a swim platform which may be placed at the top of the transom, could be as little as about 8-16 inches. Considering that the transom may already be filled with other devices, the space available for mounting of a thruster is, in practice, far less than what is shown in FIG. 3. That is why the bracket of the present invention is especially useful with wakeboard boats.

Figure 4:
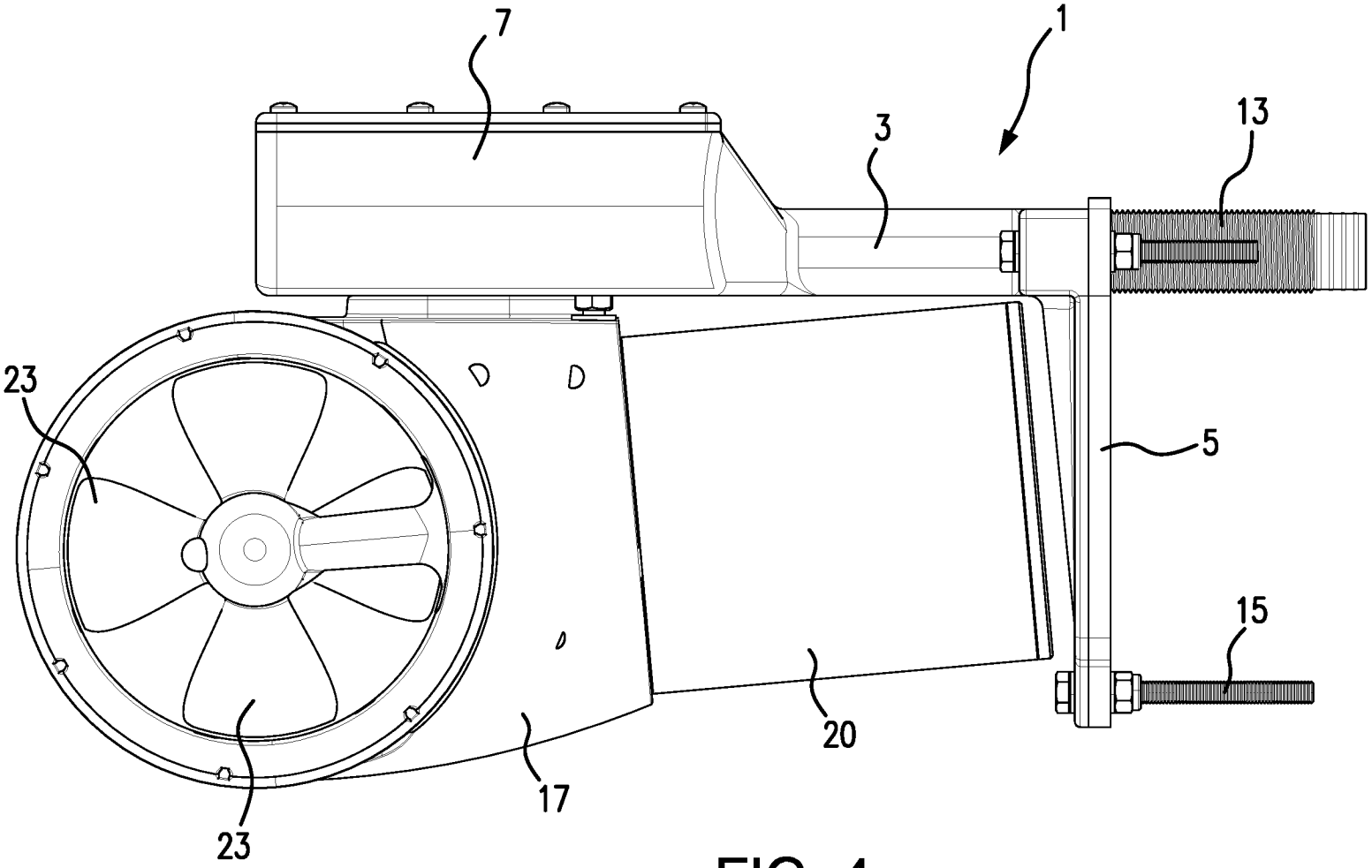
FIG. 4 provides a side elevational view of the bracket of the present invention, the bracket holding a thruster.
Figure 5:
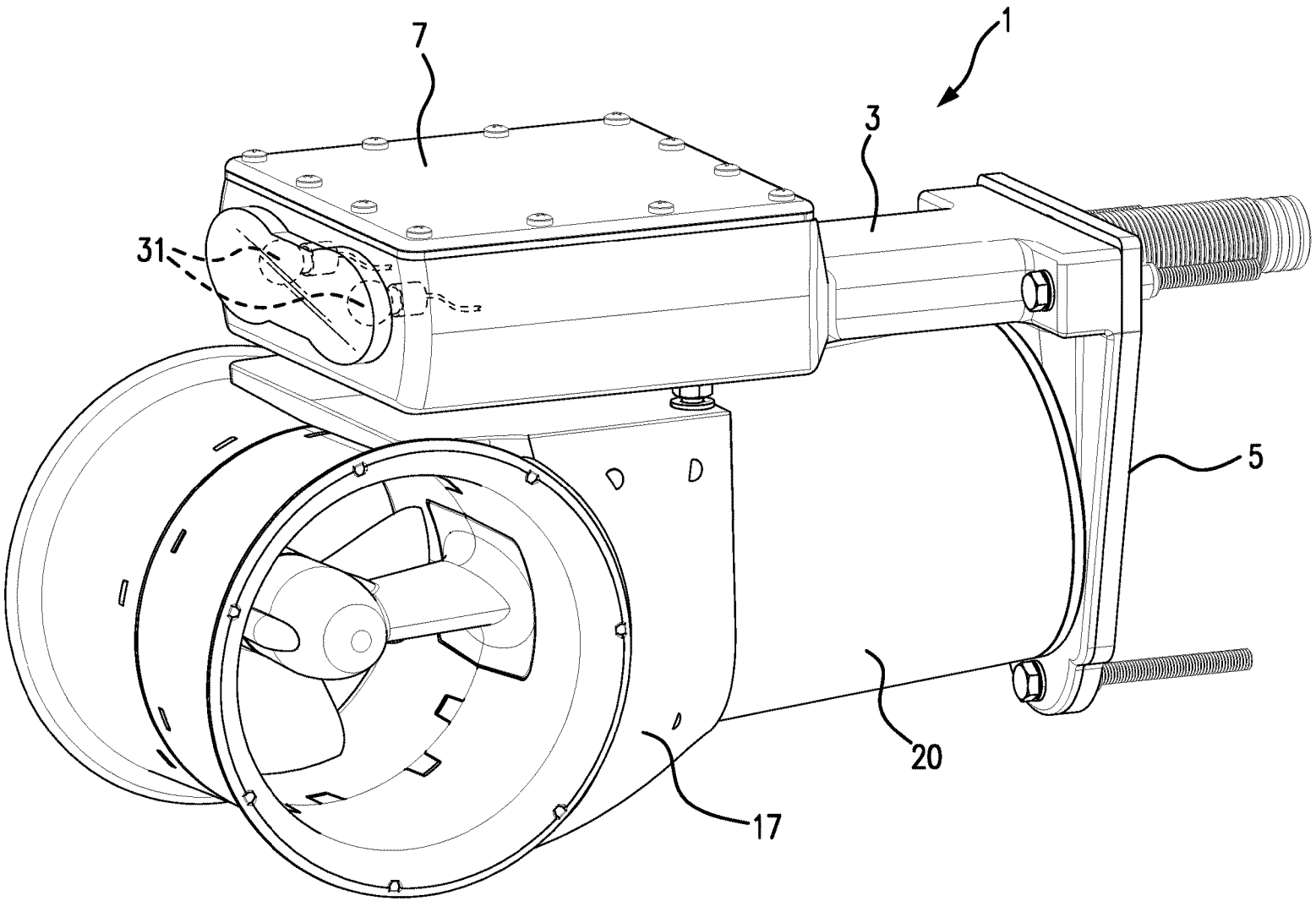
FIG. 5 provides a perspective view of the bracket of the present invention, the bracket holding a thruster, and showing the fasteners which are used to affix the bracket to a boat.

FIGS. 4 and 5 provide additional views of the combination of the bracket of the present invention, with an attached thruster. In FIG. 4, there is shown thruster 17, attached to the underside of horizontal member 3 of the bracket 1. In this view, one can see the propeller blades 23 of the thruster 17.

From FIGS. 3 and 4, it is clear that the bracket of the present invention enables the thruster to be positioned away from the transom of the boat. In FIG. 4, especially, one can see that the propeller blades are considerably displaced from the boat, which would be at the right-hand side of the figure.

FIG. 5 provides a view of the same components, from a different viewpoint. Also, FIG. 5 shows lamps 31, in dotted outline, the lamps being located within enclosure 7. Similar lamps are present in the enclosure as shown in the other figures.

An important advantage of the present invention is that it enables the mounting of the thruster such that the thruster is spaced apart from the boat. This feature is advantageous because it minimizes the space required on the transom, for mounting the thruster, and also because, by holding the thruster away from the boat, the flow of water is optimized, and the power available from the thruster is maximized. Therefore, when mounted with the bracket of the present invention, the thruster operates with maximum efficiency in maneuvering the boat.

The bracket of the present invention therefore solves the problem of dealing with the limited space available on the transom. The present invention makes it possible to mount a thruster to a boat, while taking up only a relatively small area on the transom, such area being essentially the area defined by the vertical member of the bracket.

The present invention therefore comprises a means for mounting a thruster in such a way that the thruster is held in an optimum operating position, and while providing an underwater light that can work in conjunction with the thruster.

The enclosure 7, which contains the lamp, is made water-tight to insure the integrity and longevity of the electrical connections.

The assembly comprising the bracket and the thruster can be easily installed on a boat. The installer simply places a template on the transom, drills pilot holes to receive the screws, and mounts the assembly to the boat. The assembly may be positioned beneath a swim platform (not shown) which extends, in the aft direction, from the transom of the boat.

The lamp contained within enclosure 7 can be connected to a joystick (not shown) controlled by the operator of the boat, so that the area in the vicinity of the boat becomes illuminated according to the position of the joystick.

Due to the structure of the bracket of the present invention, the lamp within enclosure 7 is effectively spaced apart from the boat hull, usually at least 12 inches away. Thus, the lamp can function as an extended rear headlight, working in conjunction with the thruster.

The invention can be modified in ways which will become apparent to those skilled in the art. The number and nature of the connectors can be varied. The length of the horizontal and vertical members can be changed. These and other modifications, which will be apparent to persons skilled in the art, should be considered within the spirit and scope of the following claims.

What is claimed is:

1. A bracket for mounting a thruster to a boat, the bracket comprising a horizontal member and a vertical member, the horizontal and vertical members being positioned generally at right angles to each other, the horizontal member including an enclosure which extends along a portion of the horizontal member, the enclosure providing space for a lamp, the enclosure having a lens disposed on a face of the enclosure for allowing light from the lamp to shine through the lens, the horizontal member including at least one connector for attachment of a thruster to the horizontal member, the vertical member including at least one connector for attaching the vertical member to a boat.

2. The bracket of claim 1, wherein the horizontal member has a length, and wherein the vertical member has a length, and wherein the length of the horizontal member is greater than or equal to the length of the vertical member.

3. The bracket of claim 1, wherein the horizontal member includes at least one fitting for attaching a thruster to the horizontal member.

4. The bracket of claim 1, wherein the enclosure is water-tight.

5. The bracket of claim 1, wherein the vertical member includes at least one threaded connector which is solid, and one threaded connector which is hollow, wherein the horizontal member is hollow, and wherein the hollow threaded connector defines a conduit for wires extending from the bracket and through the hollow threaded connector.

6. The bracket of claim 1, wherein the horizontal member includes a free end which is spaced apart from the vertical member, and wherein the enclosure is positioned at the free end of the horizontal member.

7. In combination, a thruster and a bracket, the bracket comprising a horizontal member and a vertical member, the horizontal and vertical members being positioned generally at right angles to each other, the horizontal member including an enclosure which extends along a portion of the horizontal member, the enclosure providing space for a lamp, the enclosure having a lens disposed on a face of the enclosure for allowing light from the lamp to shine through the lens, the horizontal member including at least one connector for attachment of the thruster to the horizontal member, the vertical member including at least one screw for attaching the vertical member to a boat.

8. The bracket of claim 7, wherein the horizontal member has a length, and wherein the vertical member has a length, and wherein the length of the horizontal member is greater than or equal to the length of the vertical member.

9. The bracket of claim 7, wherein the horizontal member includes at least one fitting for attaching the thruster to the horizontal member.

10. The bracket of claim 7, wherein the enclosure is water-tight.

11. The bracket of claim 7, wherein the vertical member includes at least one threaded connector which is solid, and one threaded connector which is hollow, wherein the horizontal member is hollow, and wherein the hollow threaded connector defines a conduit for wires extending from the bracket and through the hollow threaded connector.

12. The bracket of claim 7, wherein the horizontal member includes a free end which is spaced apart from the vertical member, and wherein the enclosure is positioned at the free end of the horizontal member.

13. In combination, a thruster, a bracket, and a boat, the bracket comprising a horizontal member and a vertical member, the horizontal and vertical members being positioned generally at right angles to each other, the horizontal member including an enclosure which extends along a portion of the horizontal member, the enclosure providing space for a lamp, the enclosure having a lens disposed on a face of the enclosure for allowing light from the lamp to shine through the lens, the thruster being attached to the horizontal member, the vertical member being attached to the boat.

14. The bracket of claim 13, wherein the horizontal member has a length, and wherein the vertical member has a length, and wherein the length of the horizontal member is greater than or equal to the length of the vertical member.

15. The bracket of claim 13, wherein the horizontal member includes at least one fitting for attaching the thruster to the horizontal member.

16. The bracket of claim 13, wherein the enclosure is water-tight.

17. The bracket of claim 13, wherein the vertical member includes at least one threaded connector which is solid, and one threaded connector which is hollow, wherein the horizontal member is hollow, and wherein the hollow threaded connector defines a conduit for wires extending from the bracket and through the hollow threaded connector.

18. The bracket of claim 13, wherein the horizontal member includes a free end which is spaced apart from the vertical member, and wherein the enclosure is positioned at the free end of the horizontal member.

* * * * *